US007135819B2

(12) United States Patent
Kang et al.

(10) Patent No.: US 7,135,819 B2
(45) Date of Patent: Nov. 14, 2006

(54) PLASMA DISPLAY PANEL

(75) Inventors: Jungwon Kang, Seoul (KR); Woong Kee Min, Jeollanam-do (KR)

(73) Assignee: LG Electronics Inc., Seoul (KR)

( * ) Notice: Subject to any disclaimer, the term of this patent is extended or adjusted under 35 U.S.C. 154(b) by 51 days.

(21) Appl. No.: 10/807,433

(22) Filed: Mar. 24, 2004

(65) Prior Publication Data

US 2004/0189201 A1 Sep. 30, 2004

(30) Foreign Application Priority Data

Mar. 25, 2003 (KR) ..... 10-2003-0018453
Jun. 2, 2003 (KR) ..... 10-2003-0035337

(51) Int. Cl.
*H01J 17/49* (2006.01)

(52) U.S. Cl. ..... 313/584; 313/585

(58) Field of Classification Search ..... 313/585, 313/582, 583, 584, 586, 587; 345/37, 41, 345/60; 315/169.4

See application file for complete search history.

(56) References Cited

U.S. PATENT DOCUMENTS 6,531,819 B1 * 3/2003 Nakahara et al. ..... 313/584

* cited by examiner

*Primary Examiner*—Mariceli Santiago
*Assistant Examiner*—Anne M Hines
(74) *Attorney, Agent, or Firm*—Fleshner & Kim, LLP

(57) ABSTRACT

A plasma display panel in which metal and auxiliary metal electrodes are formed such that brightness and efficiency are improved. The plasma display panel includes: transparent ITO electrodes which are spaced in parallel to each other at a predetermined distance within a discharge cell, metal electrodes which are formed in parallel to the transparent ITO electrodes and formed on verge of the transparent ITO electrodes respectively, and auxiliary metal electrodes which are formed on the transparent ITO electrodes so that they are positioned in the direction of sides of the transparent ITO electrodes which are opposite to each other, respectively.

37 Claims, 10 Drawing Sheets

【Fig. 1】
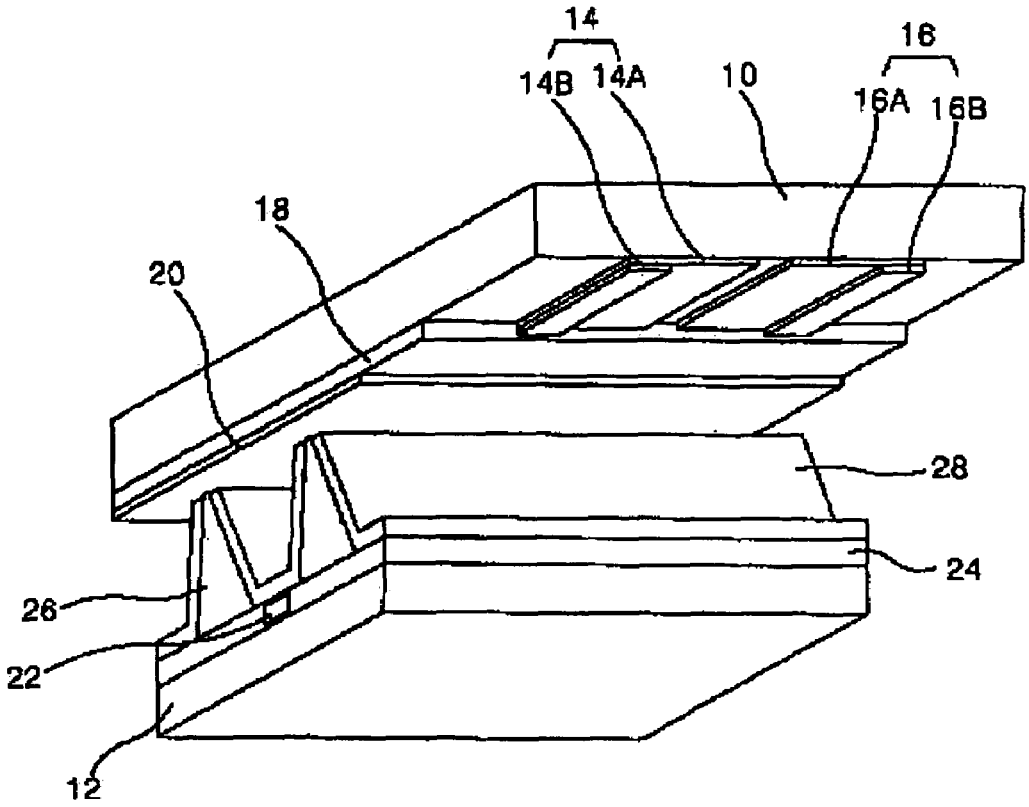
【Fig. 2】
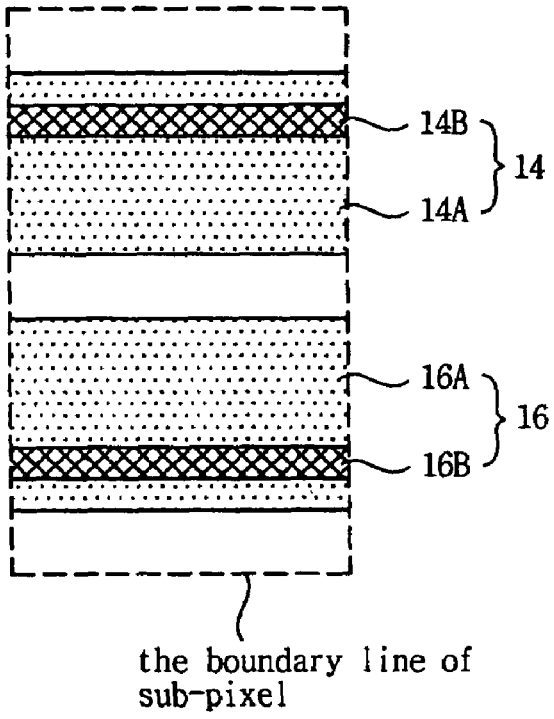

【Fig. 3】
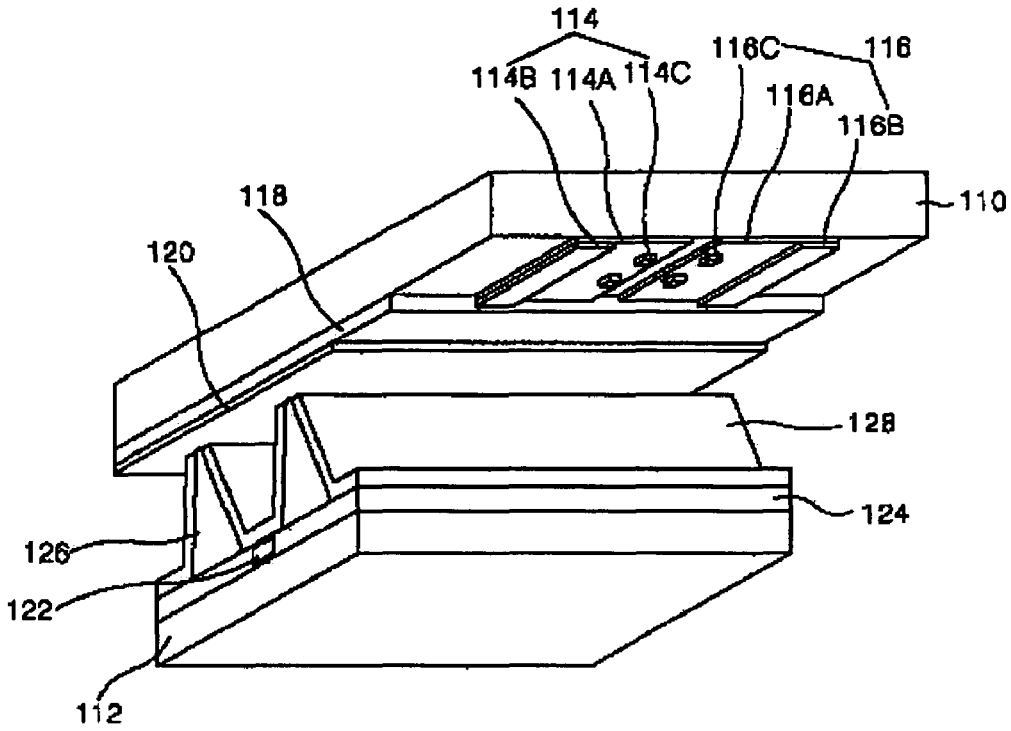
【Fig. 4】
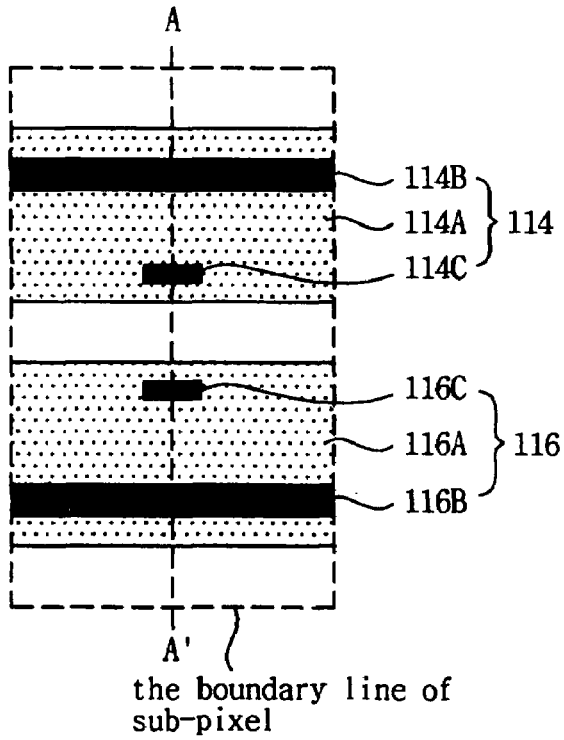

【Fig. 5】
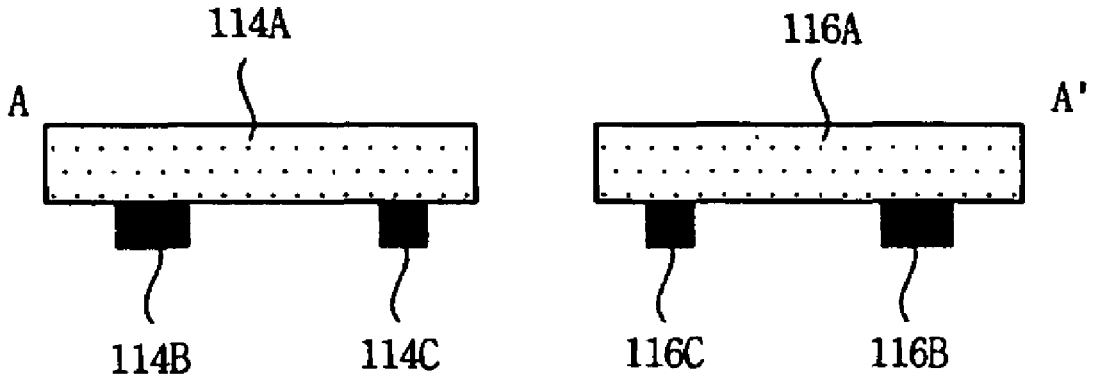
【Fig. 6】
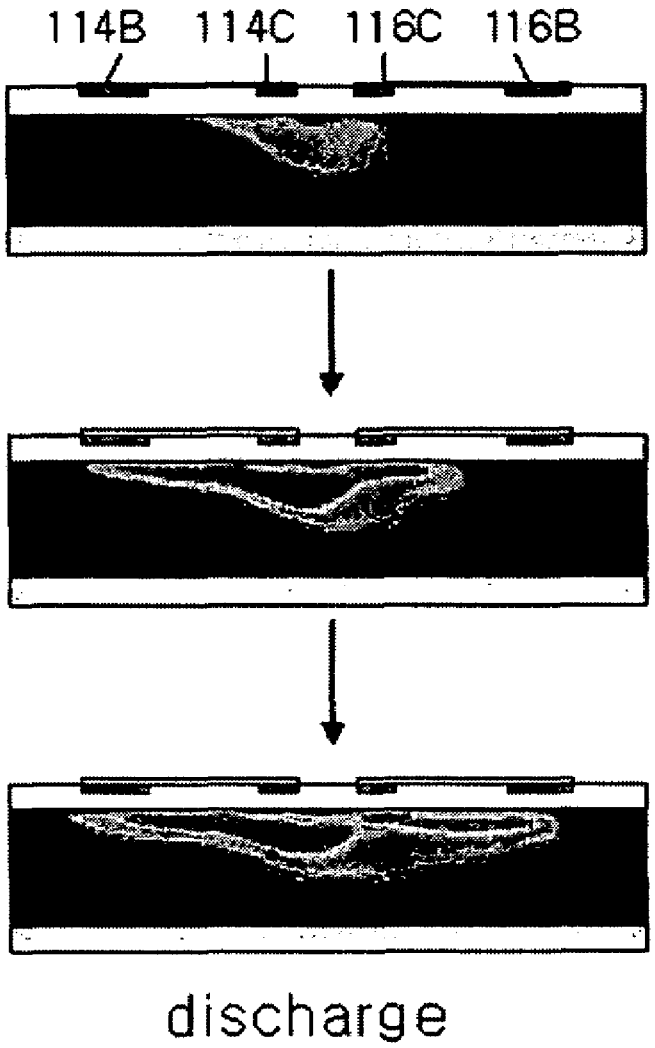

【Fig. 7】
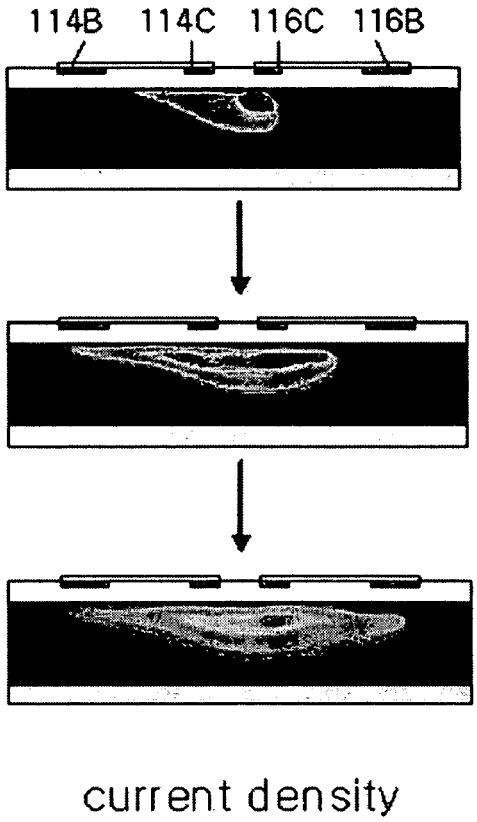
【Fig. 8】
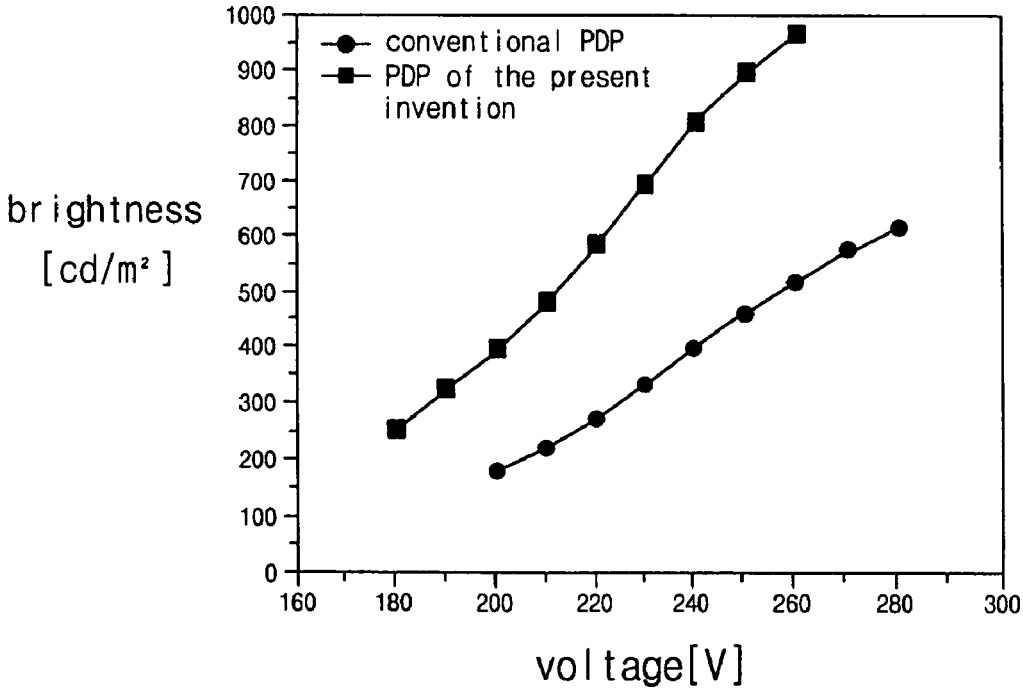

【Fig. 9】
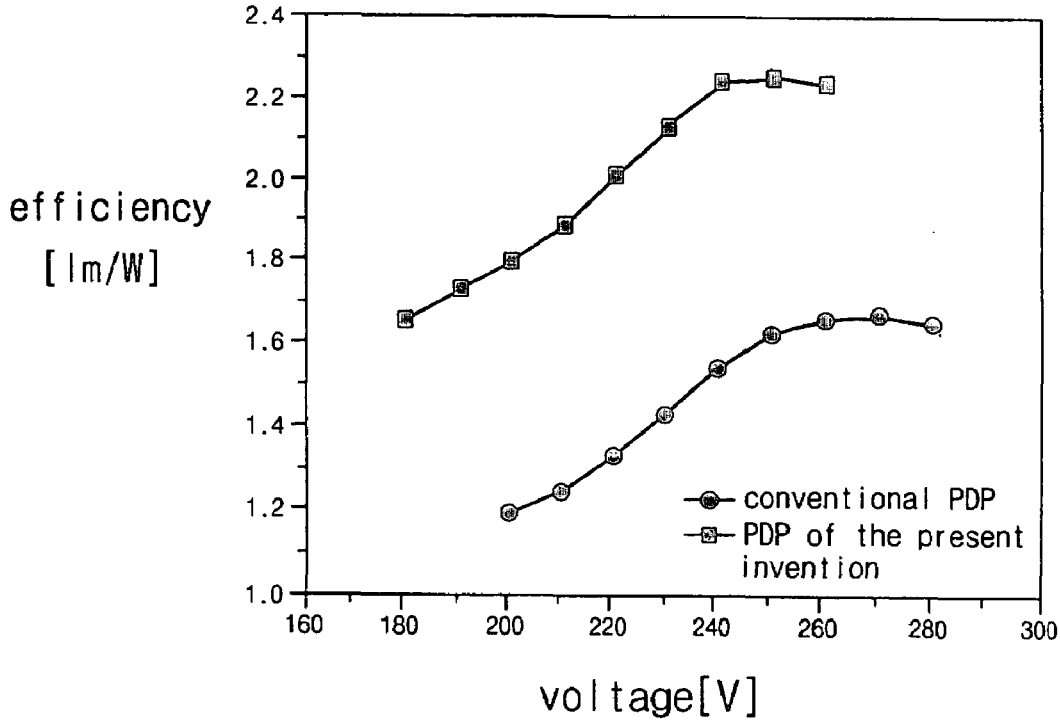
【Fig. 10】
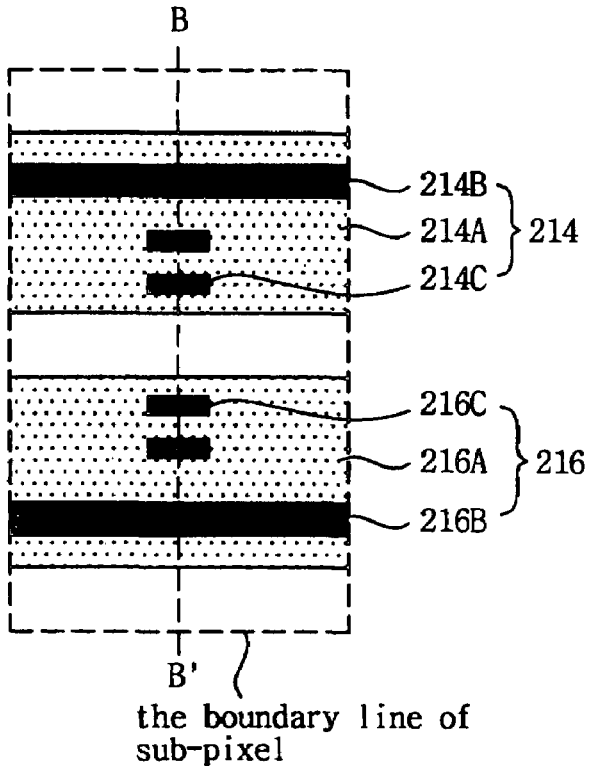

【Fig. 1 1】
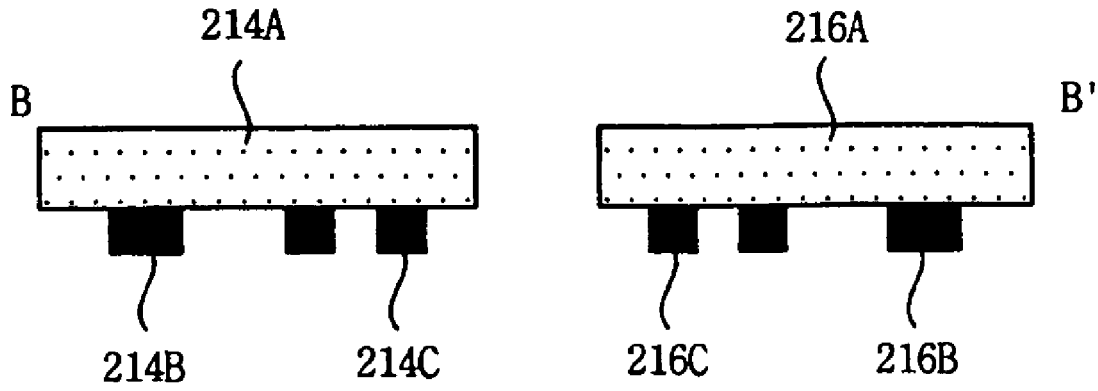
【Fig. 1 2】
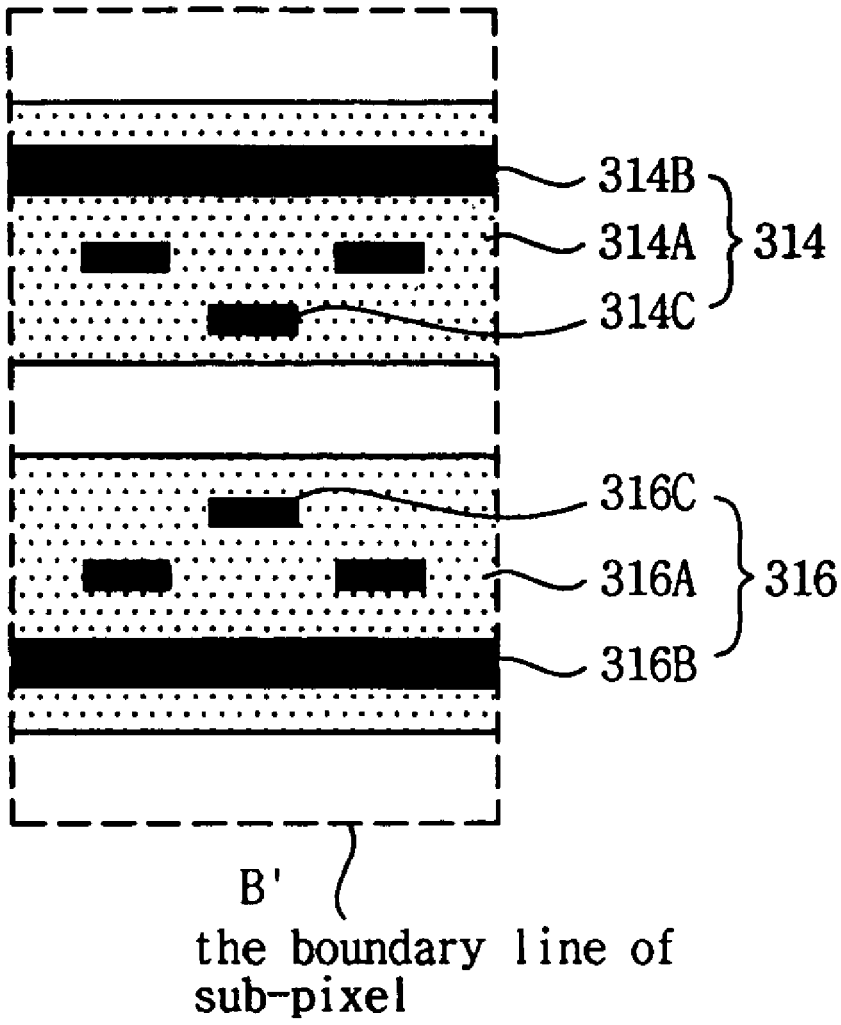

【Fig. 1 3】
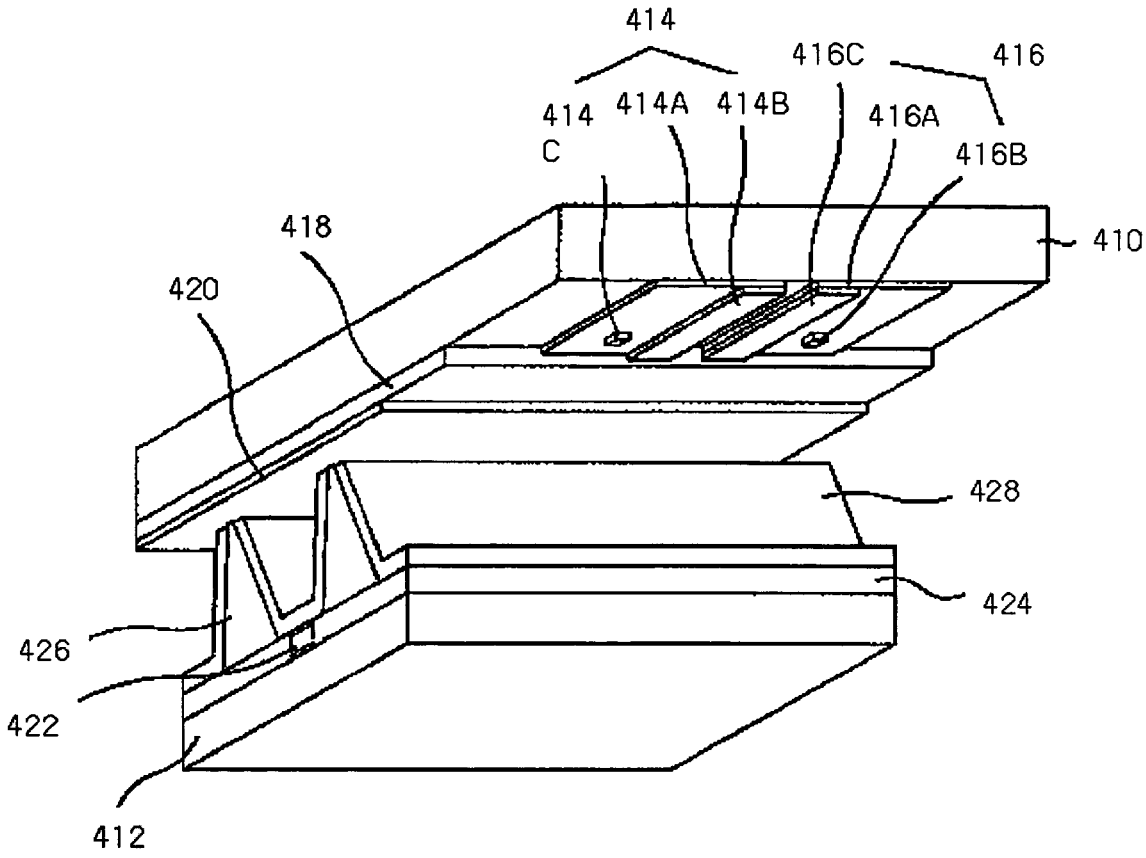
【Fig. 1 4】
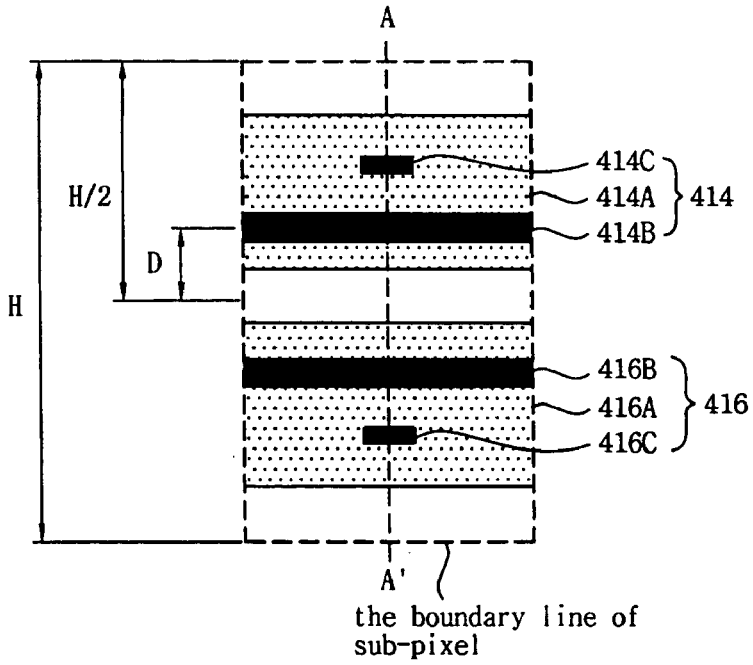

【Fig. 1 5】
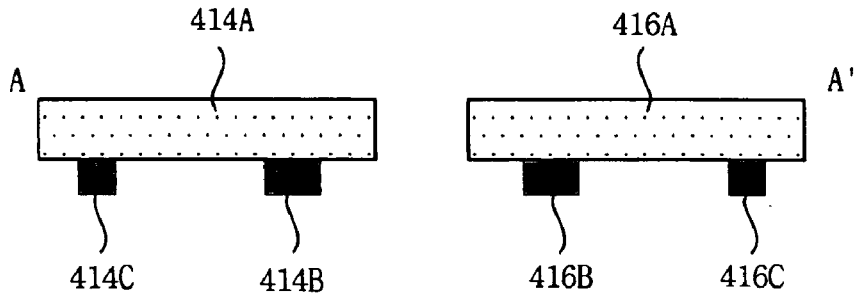
【Fig. 1 6】
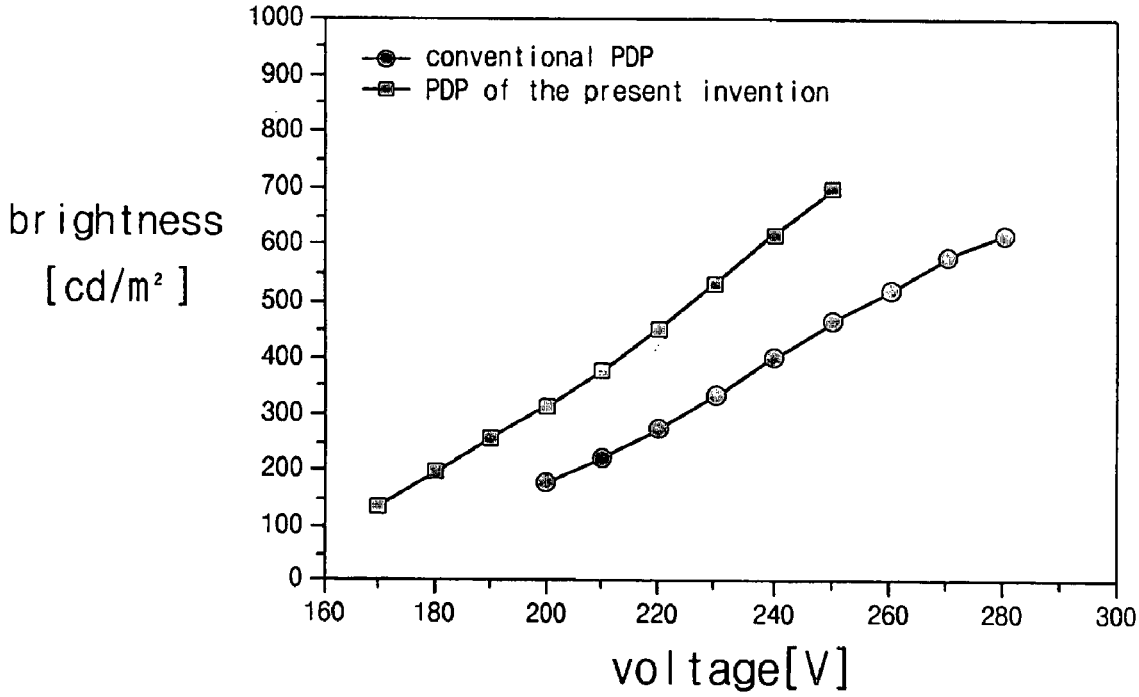

【Fig. 17】
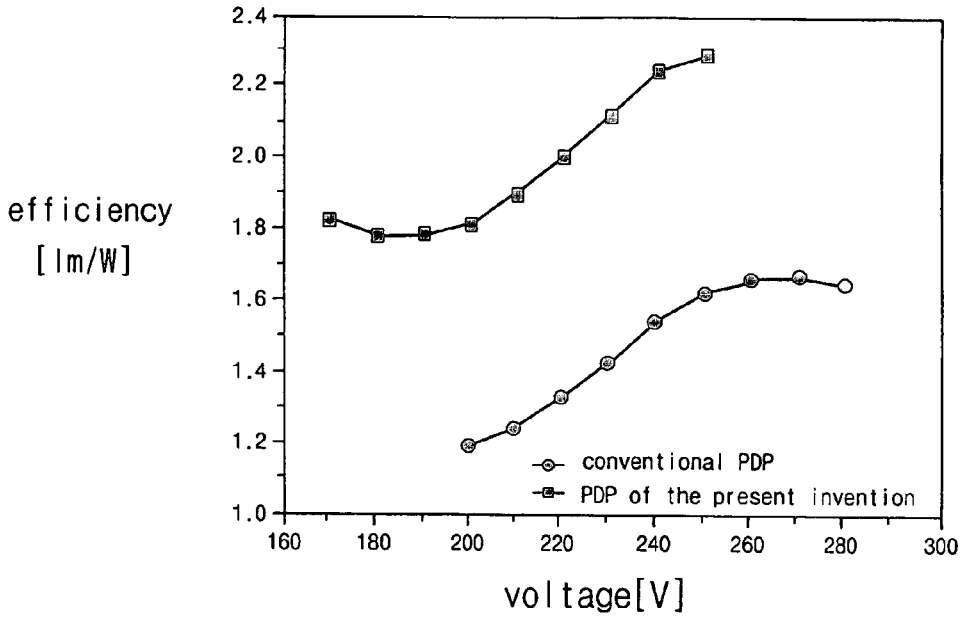
【Fig. 18】
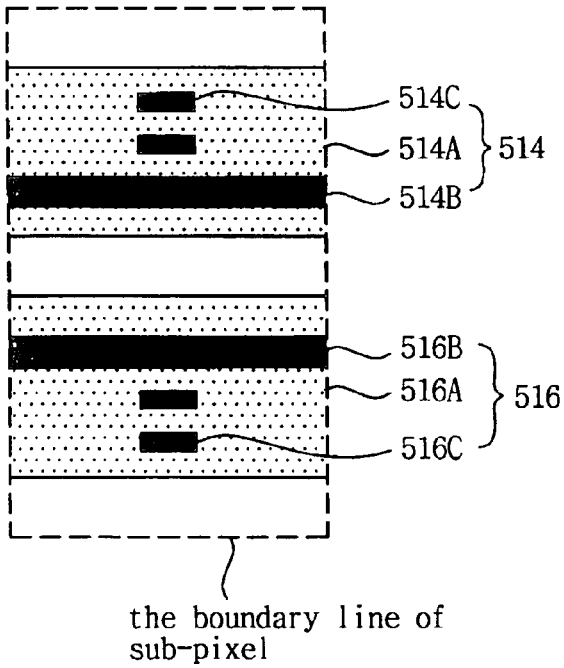

【Fig. 19】
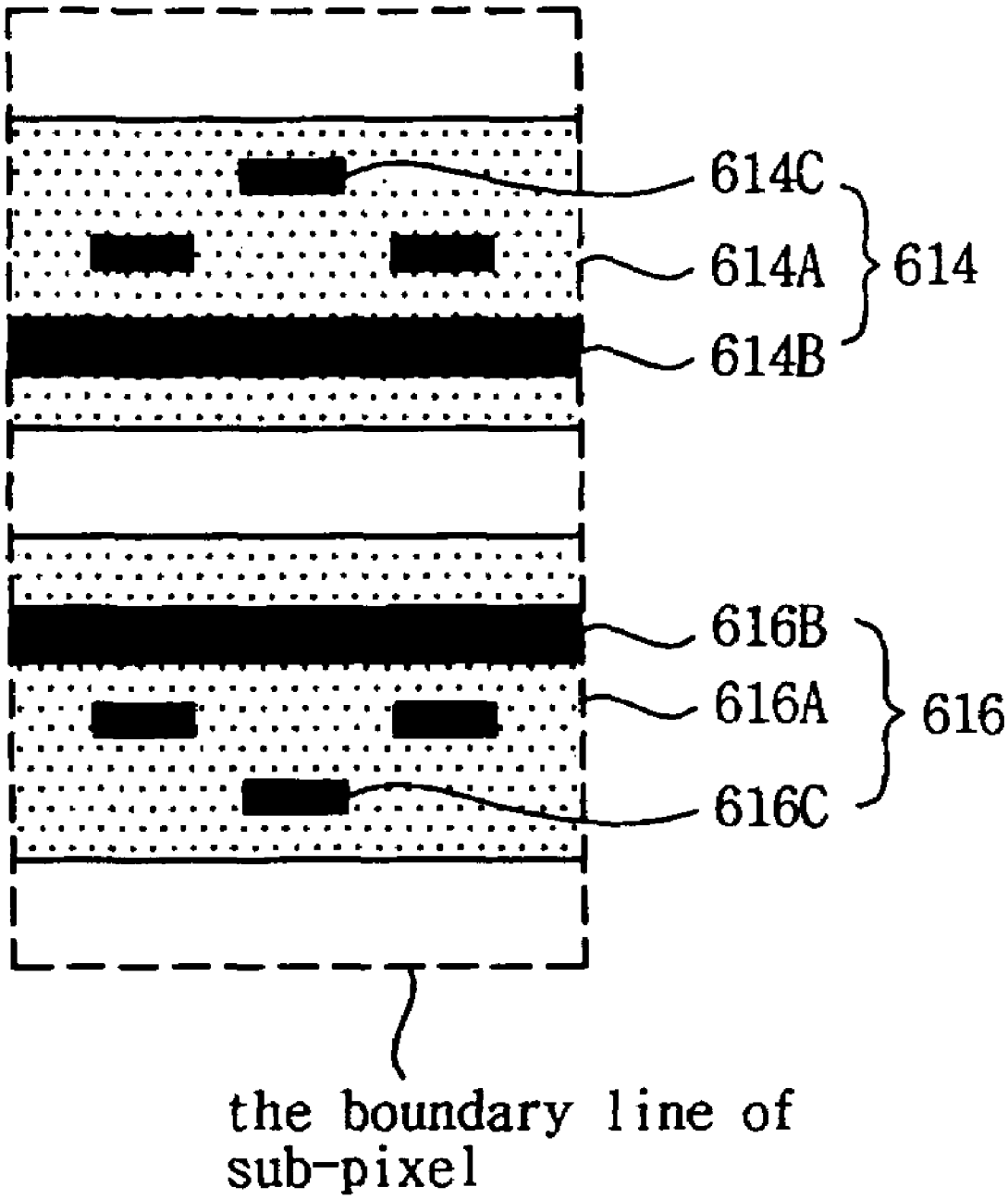

PLASMA DISPLAY PANEL

TECHNICAL FIELD

The present invention relates to a plasma display panel and more specifically to a plasma display panel in which metal and auxiliary metal electrodes are formed such that brightness and efficiency are improved.

BACKGROUND OF THE INVENTION

FIG. 1 is a perspective view illustrating a discharge cell of a general AC plasma display panel arranged in matrix shape.

As shown in FIG. 1, a conventional PDP comprises a front substrate 10 and rear substrate 12. A pair of sustain electrode 14, 16, upper dielectric layer 18 and protective layer 20 are gradually formed on the front substrate 10, and address electrodes 22, lower dielectric layer 24 and barrier ribs 26 and phosphor layer 28 are gradually formed on the rear substrate 12. The front substrate 10 and the rear substrate 12 are spaced in parallel to each other at a predetermined distance by barrier ribs 26.

Wall charges occurred upon the plasma discharge is accumulated on the upper dielectric layer 18 and the lower dielectric layer 24. The protection layer 20 serves to prevent damage of the upper dielectric layer 18 due to sputtering generated upon the plasma discharge and to increase emission efficiency of secondary electrons. The protection layer 20 is usually formed using magnesium oxide (MgO).

The address electrodes 22 are formed in the direction intersecting a pair of sustain electrodes 14, 16. A data signal is supplied for the address electrodes 22 to select a cell that is displayed.

The barrier ribs 26 are formed in parallel to the address electrode 22 and serves to prevent ultraviolet rays and a visible ray generated due to the discharge from leaking toward neighboring discharge cells. The barrier ribs 26 may be existed or not a boundary line of sub-pixel.

The phosphor layer 28 is excited by ultraviolet rays generated upon the plasma discharge to generate a visible ray of one of red, green and blue. Inert mixed gases such as He+Xe, Ne+Xe and He+Ne+Xe for discharge are inserted into a discharge space of the discharge cell formed between the upper/lower substrates 10, 12.

A pair of sustain electrode 14, 16 comprises scan electrodes 14 and sustain electrodes 16. A scan signal for scanning of the panel is supplied for scan electrodes 14 and a sustain signal for maintaining discharge of a selected cell is supplied for sustain electrodes.

A pair of sustain electrode 14, 16 comprises transparent ITO electrodes 14A, 16A, which are stripe pattern, are made of transparent material in order to transmit a visible ray and have a wide width relatively, and metal electrodes 14B, 16B, which compensate a resistance of transparent ITO electrodes 14A, 16A and have a narrow width relatively. Each of the transparent ITO electrodes of a pair of sustain electrodes 14, 16 is opposite to each other at a predetermined distance. Further, metal electrodes 14B, 16B are formed in parallel to the transparent ITO electrodes 14A, 16A and formed on a verge of the transparent ITO electrodes 14A, 16A, respectively. Namely, metal electrodes 14B, 16B are formed on outside verge of the transparent ITO electrodes 14A, 16A.

A PDP cell of this structure sustains a discharge according to surface discharge between a pair of sustain electrodes 14, 16 after being selected by opposite discharge between the address electrode 22 and the scan electrode 14. In the PDP cell, a visible ray is emitted to an outside of cell as radiating phosphors 28 by ultraviolet rays which are generated while the sustain discharge occurs. As a result, the PDP having cells displays an image. In this case, the PDP realizes a gray scale by controlling the discharge sustaining period, i.e. the number of sustain discharge according to a video data.

In the conventional PDP, Xe inert gas excites phosphors 28 using a vacuum ultraviolet generated by changing from excited state to ground state according to gas discharge. Therefore, as a content of Xe is much, a quantity of vacuum ultraviolet rays generated upon the gas discharge and the efficiency of the PDP increase. However, the increase of Xe is caused by rising discharge starting voltage and discharge sustaining voltage between sustain electrodes.

Furthermore, in the conventional PDP, the discharge starting voltage and the discharge sustaining voltage is risen because the metal electrodes 14B, 16B are formed on the outside verge of the transparent ITO electrodes 14A, 16A, respectively. Also, the brightness and efficiency of the conventional PDP are decreased.

That is, the conventional PDP structure has a difficulty in increasing brightness and efficiency without any problem such as the structure of electrodes within the discharge cell.

SUMMARY OF THE INVENTION

Accordingly, the present invention has been made in view of the above problems, and it is an object of the present invention to provide a plasma display panel for increasing brightness and efficiency.

A plasma display panel comprises: transparent ITO electrodes which are spaced in parallel to each other at a predetermined distance within a discharge cell; metal electrodes which are formed in parallel to said transparent ITO electrodes and formed on verge of said transparent ITO electrodes, respectively; and auxiliary metal electrodes which are formed on said transparent ITO electrodes so that are positioned in the direction of sides of said transparent ITO electrodes which are opposite to each other, respectively.

Further a plasma display panel comprises: transparent ITO electrodes which are spaced in parallel to each other at a predetermined distance within a discharge cell; metal electrodes which are formed on said transparent ITO electrodes and in parallel to said transparent ITO electrodes so that are positioned in the direction of sides of said transparent ITO electrodes which are opposite to each other, respectively; and auxiliary metal electrodes which are formed on verge of said transparent ITO electrodes, respectively.

BRIEF DESCRIPTION OF THE DRAWINGS

FIG. 1 is a perspective view illustrating a discharge cell of a plasma display panel of the prior art.

FIG. 2 is a plane view illustrating a pair of sustain electrodes shown in FIG. 1.

FIG. 3 is a perspective view illustrating a discharge cell of a plasma display panel according to a first embodiment of the present invention.

FIG. 4 is a plane view illustrating a pair of sustain electrodes according to the first embodiment of the present invention shown in FIG. 3.

FIG. 5 is a cross-sectional view of a pair of sustain electrodes of FIG. 4 taken along a line A–A'.

FIG. 6 is a current density of a pair of sustain electrodes during discharge shown in FIG. 4.

FIG. 7 is a discharge state of a pair of sustain electrodes shown in FIG. 4 while discharge generates.

FIG. 8 is a graph showing comparison of brightness between the first embodiment of the present invention and the prior art with respect to discharge voltage.

FIG. 9 is a graph showing comparison of efficiency between the first embodiment of the present invention and the prior art with respect to discharge voltage.

FIG. 10 is a plane view illustrating a pair of sustain electrodes according to a modification of the first embodiment.

FIG. 11 is a cross-sectional view of a pair of sustain electrodes of FIG. 10 taken along a line B–B'.

FIG. 12 is a plane view illustrating a pair of sustain electrodes according to another modification of the first embodiment.

FIG. 13 is a perspective view illustrating a discharge cell of a plasma display panel according to the second embodiment of the present invention.

FIG. 14 is a plane view illustrating a pair of sustain electrodes shown in FIG. 13.

FIG. 15 is a cross-sectional view of a pair of sustain electrodes of FIG. 14 taken along a line A–A'.

FIG. 16 is a graph showing comparison of brightness between the second embodiment of the present invention and the prior art with respect to discharge voltage.

FIG. 17 is a graph showing comparison of efficiency between the second embodiment of the present invention and the prior art with respect to discharge voltage.

FIG. 18 is a plane view illustrating a pair of sustain electrodes according to a modification of the second embodiment.

FIG. 19 is a plane view illustrating a pair of sustain electrodes according to another modification of the second embodiment.

DETAILED DESCRIPTION OF THE INVENTION

Reference will now be made in detail to the preferred embodiments of the present invention, examples of which are illustrated in the accompanying drawings.

The First Embodiment

FIG. 3 is a perspective view illustrating a discharge cell of a plasma display panel according to a first embodiment of the present invention, FIG. 4 is a plane view illustrating a pair of sustain electrodes according to the first embodiment of the present invention shown in FIG. 3, and FIG. 5 is a cross-sectional view of a pair of sustain electrodes of FIG. 4 taken along a line A–A'.

As shown in FIG. 3, a plasma display panel according to the first embodiment of the present invention has a front substrate 110 and rear substrate 112. A pair of sustain electrodes 114, 116, upper dielectric layer 118 and protective layer 120 are gradually formed on the front substrate 110, and address electrodes 122, lower dielectric layer 124 and barrier ribs 126 and phosphor layer 28 are gradually formed on the rear substrate 112. The front substrate 110 and the rear substrate 112 are spaced in parallel to each other at a predetermined distance by barrier ribs 126.

According to the first embodiment of the present invention, the sustain electrodes 114, 116 are consisted of the transparent ITO electrodes 114A, 116A and the metal electrodes 114B, 116B and the auxiliary metal electrodes 114C, 116C on the transparent ITO electrodes 114A, 116A.

Each of the transparent ITO electrodes 114A, 116A of a pair of sustain electrodes 114, 116 are opposite to each other at a predetermined distance.

The transparent ITO electrodes 114A, 116A are made of transparent material in order to transmit a visible ray, and have a stripe pattern of a wide width relatively.

The metal electrodes 114B, 116B are formed on a verge of the transparent ITO 114A, 116A and have a stripe pattern of a narrow width relatively, respectively. The metal electrodes 114B, 116B and the auxiliary metal electrodes 114C, 116C made of material having a good conductivity in order to compensate a conductivity of transparent ITO electrodes 114A, 116A.

As shown in FIG. 4 and FIG. 5, each of the auxiliary metal electrodes 114A, 116A is formed in stripe shape of smaller. size than a width of the transparent ITO electrodes 114A, 116A and is formed so that are positioned in the direction of sides of the transparent ITO electrodes 114A, 116A which are opposite to each other. Preferably, each of the auxiliary metal electrodes 114C, 116C is a quadrangle and is formed in parallel and in equidistance with the transparent ITO electrodes 114A, 116A.

A discharge voltage supplied from the metal electrodes 114B, 116B via the transparent ITO electrodes 114A, 116A is applied to each of the auxiliary metal electrodes 114C, 116C. In this result, each of the auxiliary metal electrodes 114C, 116C induces a strong electric field in the central portion of discharge cell and the discharge starting voltage and the discharge sustaining voltage are decreased.

A PDP cell of this structure is sustained a discharge according to surface discharge between a pair of sustain electrodes 114, 116 after being selected by opposite discharge between the address electrode 122 and the scan electrode 114. As shown in FIG. 6, at this time of the surface discharge, a current density strongly generates between the auxiliary metal electrodes 114C, 116C of the central portion of the discharge cell, and then expands in the direction of the metal electrodes 114B, 116B situated the outside of the discharge cell, gradually.

Further, as shown in FIG. 7, at this time of the surface discharge, a strong discharge generates between the auxiliary metal electrodes 114C, 116C of the central portion of the discharge cell, and then expands in the direction of the metal electrodes 114B, 116B situated the outside of the discharge cell, gradually. And, in the PDP cell, a visible ray is emitted to the outside cell as radiating phosphors 128 by generated ultraviolet rays when the sustain discharge occurs. In result, the PDP having cells displays an image. In this case, the PDP implements a gray scale depending on the number of discharge according to a video data.

In the conventional PDP, Xe inert gas excites phosphors 28 using a vacuum ultraviolet generated upon changing from excited state to ground state. Therefore, as a content of Xe is much, a quantity of vacuum ultraviolet rays generated upon the gas discharge and the efficiency of the PDP increase. However, the increase of Xe is caused by rising discharge starting voltage and discharge sustaining voltage between sustain electrodes.

However, in the PDP according to the first embodiment of the present invention, the discharge starting voltage and discharge sustaining voltage are decreased and the brightness and efficiency are increased at this time of the discharge, although the contents of Xe inert gas increases.

In the concrete, since the distance between the auxiliary metal electrodes 114C, 116C is near, the strong electric field generates at the central portion of the discharge cell, at this time of the discharge. And, the discharge starting voltage and discharge sustaining voltage are decreased by the strong electric field generated at the central portion of the discharge cell. Therefore, as shown in FIG. 8 and FIG. 9, the brightness of the PDP according to the first embodiment of the present invention is improved the maximum 57% than the conventional PDP at the discharge voltage, 260V, and the efficiency of the PDP according to the first embodiment of the present invention is improved approximately 39% than the conventional PDP at the discharge voltage, 200V.

FIG. 10 is a plane view illustrating a pair of sustain electrodes according to a modification of the first embodiment.

The description of the same elements with the first embodiment of the present invention shown in FIG. 3 is omitted.

According to the modification of the first embodiment of the present invention, the sustain electrodes 214, 216 are consisted of the transparent ITO electrodes 214A, 216A and the metal electrodes 214B, 216B and the auxiliary metal electrodes 214C, 216C on the transparent ITO electrodes 214A, 216A.

Each of the transparent ITO electrodes 214A, 216A of a pair of sustain electrodes 214, 216 are opposite to each other at a predetermined distance.

The transparent ITO electrodes 214A, 216A are made of transparent material in order to transmit a visible ray and have a stripe pattern of a wide width relatively.

The metal electrodes 214B, 216B are formed on a verge of the transparent ITO 214A, 216A and have a stripe pattern of a narrow width relatively, respectively. The metal electrodes 214B, 216B and the auxiliary metal electrodes 214C, 216C are made of material having a good conductivity in order to compensate a conductivity of transparent ITO electrodes 214A, 216A.

As shown in FIG. 10 and FIG. 11, each of the auxiliary metal electrodes 214C, 216C is formed in stripe shape of smaller size than a width of the transparent ITO electrodes 214A, 216A and is formed so that are positioned in the direction of sides of the transparent ITO electrodes 214A, 216A which are opposite to each other. Preferably, each of the auxiliary metal electrodes 214C, 216C is a quadrangle and is formed in parallel and in equidistance with the transparent ITO electrodes 214A, 216A. The auxiliary metal electrodes 214C, 216C are formed on the opposite sides of the transparent ITO electrodes 214A, 216A in single and double line and are formed in parallel and in equidistance each other.

A discharge voltage supplied from the metal electrodes 214B, 216B via the transparent ITO electrodes 214A, 216A is applied to each of the auxiliary metal electrodes 214C, 216C. In this result, each of the auxiliary metal electrodes 214C, 216C induces a strong electric field in the central portion of discharge cell and the discharge starting voltage and the discharge sustaining voltage are decreased.

In this time, the appearance of the current density and discharge is similar to that shown in FIG. 6 and FIG. 7 and the characteristic of the brightness and efficiency are similar to that shown in FIG. 8 and FIG. 9.

FIG. 12 is a plane view illustrating a pair of sustain electrodes according to another modification of the first embodiment.

The description of the same elements with the first embodiment of the present invention shown in FIG. 3 is omitted.

According to another transformation of the first embodiment of the present invention, the sustain electrodes 314, 316 are consisted of the transparent ITO electrodes 314A, 316A and the metal electrodes 314B, 316B and the auxiliary metal electrodes 314C, 316C on the transparent ITO electrodes 314A, 316A.

Each of the transparent ITO electrodes 314A, 316A of a pair of sustain electrodes 314, 316 are opposite to each other at a predetermined distance.

The transparent ITO electrodes 314A, 316A are made of transparent material in order to transmit a visible ray and have a stripe pattern of a wide width relatively.

The metal electrodes 314B, 316B are formed on a verge of the transparent ITO 314A, 316A and have a stripe pattern of a narrow width relatively, respectively. The metal electrodes 314B, 316B and the auxiliary metal electrodes 314C, 316C made of material having a good conductivity in order to compensate a conductivity of transparent ITO electrodes 314A, 316A.

As shown in FIG. 12, each of the auxiliary metal electrodes 314A, 316A is formed in stripe shape of smaller size than a width of the transparent ITO electrodes 314A, 316A and is formed so that are positioned in the direction of sides of the transparent ITO electrodes 314A, 316A which are opposite to each other. Preferably, each of the auxiliary metal electrodes 314C, 316C is a quadrangle and is formed in parallel and in equidistance with the transparent ITO electrodes 314A, 316A. Furthermore, each of the auxiliary metal electrodes 314C, 316C consists of three electrodes made of triangular shape.

A discharge voltage supplied from the metal electrodes 314B, 316B via the transparent ITO electrodes 314A, 316A is applied to each of the auxiliary metal electrodes 314C, 316C. In this result, each of the auxiliary metal electrodes 314C, 316C induces a strong electric field in the central portion of discharge cell and the discharge starting voltage and the discharge sustaining voltage are decreased.

In this time, the appearance of the current density and discharge is similar to that shown in FIG. 6 and FIG. 7 and the characteristic of the brightness and efficiency are similar to that shown in FIG. 8 and FIG. 9.

The Second Embodiment

FIG. 13 is a perspective view illustrating a discharge cell of a plasma display panel according to the second embodiment of the present invention, FIG. 14 is a plane view illustrating a pair of sustain electrodes shown in FIG. 13 and FIG. 15 is a cross-sectional view of a pair of sustain electrodes of FIG. 14 taken along a line A–A'.

The description of the same elements with the first embodiment of the present invention shown in FIG. 3 is omitted.

According to the second embodiment of the present invention, the sustain electrodes 414, 416 are consisted of the transparent ITO electrodes 414A, 416A and the metal electrodes 414B, 416B and the auxiliary metal electrodes 414C, 416C on the transparent ITO electrodes 414A, 416A.

Each of the transparent ITO electrodes 414A, 416A of a pair of sustain electrodes 414, 416 are opposite to each other at a predetermined distance.

Each of the metal electrodes 414B, 416B is formed on the transparent ITO electrodes 414A, 416A between a central portion of the transparent ITO electrodes 414A, 416A and a central portion of the discharge cell.

That is, each of the metal electrodes 414B, 416B is formed on the transparent ITO electrodes 414A, 416A so that is positioned in the direction of sides of the transparent ITO electrodes 414A, 416A which are opposite to each other.

Preferably, the position of each of the metal electrodes 414B, 416B satisfies the following the equation 1.

$$D<H/4 \quad \text{[Equation. 1]}$$

Wherein H represents a length of discharge cell, D represents a distance between a central portion of the metal electrodes 414B, 416B and a central portion of the discharge cell.

Each of the metal electrodes 414B, 416B induces a strong electric field in the central portion of discharge cell and the discharge starting voltage and the discharge sustaining voltage are decreased.

As shown in FIG. 14, each of the auxiliary metal electrodes 414C, 416C is formed in stripe shape of smaller size than a width of the transparent ITO electrodes 414A, 416A and is formed so that are positioned in the direction of sides of the transparent ITO electrodes 414A, 416A which are opposite to each other. Preferably, each of the auxiliary metal electrodes 414C, 416C is a quadrangle.

A surface discharge is occurred between the metal electrodes 414B, 416B by applied voltage, and then the discharge is expanded in the direction of the outside sides of the discharge cell by the auxiliary metal electrodes 414C, 416C.

In the PDP according to the second embodiment of the present invention, the discharge starting voltage and discharge sustaining voltage are decreased and the brightness and efficiency are increased at this time of the discharge, although the contents of Xe inert gas increases. In the concrete, since the distance between the metal electrodes 414B, 416B is near, the strong electric field generates at the central portion of the discharge cell, at this time of the discharge, and then the discharge is expanded in the direction of the verge of the discharge cell. In this result, the discharge starting voltage and discharge sustaining voltage are decreased by the generated strong electric field at the central portion of the discharge cell and the brightness and efficiency are increased. Furthermore, since the discharge starting voltage and the discharge delay time are decreased, the stability of the discharge is improved.

The brightness and efficiency of the second embodiment according to the present invention and the conventional PDP show in FIG. 16 and FIG. 17. As shown in FIG. 16, the brightness of the PDP according to the second embodiment of the present invention is improved the approximately 50% to 70% than the conventional PDP at the same discharge voltage. As shown in FIG. 16, the efficiency of the PDP according to the second embodiment of the present invention is improved approximately 40% to 50% than the conventional PDP at the same discharge voltage.

FIG. 18 is a plane view illustrating a pair of sustain electrodes according to a modification of the second embodiment.

According to a modification of the second embodiment of the present invention, the sustain electrodes 514, 516 are consisted of the transparent ITO electrodes 514A, 516A and the metal electrodes 514B, 516B and the auxiliary metal electrodes 514C, 516C on the transparent ITO electrodes 514A, 516A.

Each of the transparent ITO electrodes 514A, 516A of a pair of sustain electrodes 514, 516 are opposite to each other at a predetermined distance.

The transparent ITO electrodes 514A, 516A are made of transparent material in order to transmit a visible ray and have a stripe pattern of a wide width relatively.

Each of the metal electrodes 514B, 516B is formed on the transparent ITO electrodes 514A, 516A between a central portion of the transparent ITO electrodes 514A, 516A and a central portion of the discharge cell.

That is, each of the metal electrodes 514B, 516B is formed on the transparent ITO electrodes 514A, 516A so that is positioned in the direction of sides of the transparent ITO electrodes 514A, 516A which are opposite to each other.

Each of the metal electrodes 514B, 516B induces a strong electric field in the central portion of discharge cell and the discharge starting voltage and the discharge sustaining voltage are decreased.

As shown in FIG. 18, the auxiliary metal electrodes 514C, 516C are formed in stripe shape of smaller size than a width of the transparent ITO electrodes 514A, 516A between verge of the transparent ITO electrodes 514A, 516A and the metal electrodes 514B, 516B, respectively. Preferably, each of the auxiliary metal electrodes 514C, 516C is a quadrangle and is formed in single and double line and in parallel and in equidistance each other.

The surface discharge is occurred between the metal electrodes 514B, 516B via applied voltage, and then the discharge is expanded in the direction of the outside sides of the discharge cell by the auxiliary metal electrodes 514C, 516C.

FIG. 19 is a plane view illustrating a pair of sustain electrodes according to another modification of the second embodiment.

According to another modification of the second embodiment of the present invention, the sustain electrodes 614, 616 are consisted of the transparent ITO electrodes 614A, 616A and the metal electrodes 614B, 616B and the auxiliary metal electrodes 614C, 616C on the transparent ITO electrodes 614A, 616A.

Each of the transparent ITO electrodes 614A, 616A of a pair of sustain electrodes 614, 616 are opposite to each other at a predetermined distance.

The transparent ITO electrodes 614A, 616A are made of transparent material in order to transmit a visible ray and have a stripe pattern of a wide width relatively.

Each of the metal electrodes 614B, 616B is formed on the transparent ITO electrodes 614A, 616A between a central portion of the transparent ITO electrodes 614A, 616A and a central portion of the discharge cell.

That is, each of the metal electrodes 614B, 616B is formed on the transparent ITO electrodes 614A, 616A so that is positioned in the direction of sides of the transparent ITO electrodes 614A, 616A which are opposite to each other.

Each of the metal electrodes 614B, 616B induces a strong electric field in the central portion of discharge cell and the discharge starting voltage and the discharge sustaining voltage are decreased.

As shown in FIG. 19, the auxiliary metal electrodes 614C, 616C are formed in stripe shape of smaller size than a width of the transparent ITO electrodes 614A, 616A between verge of the transparent ITO electrodes 614A, 616A and the metal electrodes 614B, 616B, respectively. Preferably, each of the auxiliary metal electrodes 614C, 616C is a quadrangle and consists of three electrodes made of triangular shape.

The surface discharge is occurred between the metal electrodes 614B, 616B via applied voltage, and then the discharge is expanded in the direction of the outside sides of the discharge cell by the auxiliary metal electrodes 614C, 616C.

INDUSTRIAL APPLICABILITY

In a plasma display panel according to a first embodiment of the present invention, an auxiliary metal electrode induces a strong electric field in the central portion of discharge cell and the discharge starting voltage and the discharge sustaining voltage are decreased. Therefore, the present invention has an effect that it can increase the brightness and efficiency at the same discharge voltage.

In a plasma display panel according to a second embodiment of the present invention, since a distance between metal electrodes is near, the strong electric field generates at the central portion of the discharge cell and the discharge is expanded in the direction of the verge of the discharge cell by an auxiliary metal electrode. Therefore, the discharge starting voltage and discharge sustaining voltage are decreased and the brightness and efficiency are increased at the same discharge voltage. Furthermore, as the discharge starting voltage and the discharge delay time are decreased, the stability of the discharge is improved.

What is claimed is:

1. A plasma display panel comprising:

transparent ITO electrodes which are spaced in parallel to each other at a predetermined distance within a discharge cell;

metal electrodes which are formed in parallel to said transparent ITO electrodes and formed on verge of said transparent ITO electrodes, respectively; and auxiliary metal electrodes which are formed on said transparent ITO electrodes so that they are positioned in the direction of sides of said transparent ITO electrodes which are opposite to each other, respectively, wherein the auxiliary metal electrodes are separated from the metal electrodes by the transparent ITO electrodes.

2. The plasma display panel of claim 1, wherein said auxiliary metal electrodes are formed between a middle of the direction perpendicular to the longitudinal axis of the transparent ITO electrodes in the plane view of the electrodes and the longitudinal sides of the transparent ITO electrodes in the plane view of the electrodes, respectively.

3. The plasma display panel of claim 2, wherein said auxiliary metal electrodes are more than two and formed in parallel to each other within said transparent ITO electrodes, respectively.

4. The plasma display panel of claim 2, wherein said auxiliary metal electrodes are three and formed in triangular shape on said transparent ITO electrodes, respectively.

5. The plasma display panel of claim 2, wherein each of said auxiliary metal electrodes is quadrangular shape.

6. The plasma display panel of claim 1, wherein said auxiliary metal electrodes have numerous electrode patterns formed in equidistance, respectively.

7. A plasma display panel comprising:

transparent ITO electrodes which are spaced in parallel to each other at a predetermined distance within a discharge cell;

metal electrodes which are formed on said transparent ITO electrodes and in parallel to said transparent ITO electrodes so that they are positioned in the direction of sides of said transparent ITO electrodes which are opposite to each other, respectively; and auxiliary metal electrodes which are formed on verge of said transparent ITO electrodes, respectively wherein the auxiliary metal electrodes are separated from the metal electrodes by the transparent ITO electrodes.

8. The plasma display panel of claim 7, wherein said metal electrodes are formed between a middle of the direction perpendicular to the longitudinal axis of the transparent ITO electrodes in the plane view of the electrodes and the longitudinal sides of the ITO electrodes in the plane view of the electrodes, respectively.

9. The plasma display panel of claim 8, wherein said auxiliary metal electrodes are more than two and formed in parallel to each other within said transparent ITO electrodes, respectively.

10. The plasma display panel of claim 8, wherein said auxiliary metal electrodes are three and formed in triangular shape on said transparent ITO electrodes, respectively.

11. The plasma display panel of claim 8, wherein each of said auxiliary metal electrodes is quadrangular shape.

12. The plasma display panel of claim 7, wherein said auxiliary metal electrodes have numerous electrode patterns formed in equidistance, respectively.

13. A plasma display panel comprising a discharge cell comprising:

a substrate;

a transparent electrode pair which are formed in parallel to each other at a predetermined distance on the substrate;

a main metal electrode pair which are formed in parallel to the transparent electrode pair on the transparent electrode pair, respectively; and an auxiliary metal electrode pair which are formed on the transparent electrode pair so that they are separated from the main metal electrode pair by the transparent electrode pair.

14. The plasma display panel of claim 13, wherein the main metal electrode pair are positioned on the outward side of a discharge gap of the discharge cell and the auxiliary metal electrode pair are positioned on the inward side of the discharge gap of the discharge cell.

15. The plasma display panel of claim 14, wherein the auxiliary metal electrode pair are more than two pairs.

16. The plasma display panel of claim 14, wherein the auxiliary metal electrode pair are positioned on the center of the discharge cell.

17. The plasma display panel of claim 16, wherein the auxiliary metal electrode pair are positioned in parallel to the longitudinal axis of the main metal electrode pair, and are more than two pairs.

18. The plasma display panel of claim 16, wherein the auxiliary metal electrode pair are formed into more than two pairs in and around the center of the discharge cell.

19. The plasma display panel of claim 18, wherein the auxiliary metal electrode pair are formed into three pairs which are one pair in the center of the discharge cell and each one pair around the center of discharge cell.

20. The plasma display panel of claim 18, wherein the auxiliary metal electrode pair formed in the center of the discharge cell are positioned on the more inward side of the discharge gap than the auxiliary metal electrode pair formed around the center of the discharge cell.

21. The plasma display panel of claim 19, wherein the auxiliary metal electrode pair formed in the center of discharge cell are positioned on the more inward side of discharge gap than the auxiliary metal electrode pair formed around the center of discharge cell.

22. The plasma display panel of claim 17, wherein the auxiliary metal electrode pair are formed in equidistance, respectively.

23. The plasma display panel of claim 13, wherein the auxiliary metal electrode pair are quadrangular shape.

24. The plasma display panel of claim 23, wherein the auxiliary metal electrode pair are rectangular form in the direction of the longitudinal axis of the main metal electrode.

25. The plasma display panel of claim 13, wherein the main meal electrode pair are positioned on the inward side of discharge gap of the discharge cell and the auxiliary metal electrode pair are positioned on the outward side of discharge gap of the discharge cell.

26. The plasma display panel of claim 25, wherein the auxiliary metal electrode pair are more than two pairs.

27. The plasma display panel of claim 25, wherein the auxiliary metal electrode pair are positioned on the outward side of the center of the discharge cell.

28. The plasma display panel of claim 27, wherein the auxiliary metal electrode pair are positioned in parallel to the longitudinal axis of the main metal electrode pair, and are more than two pairs.

29. The plasma display panel of claim 27, wherein the auxiliary metal electrode pair are formed into more than two pairs in and around the outward side of the center of discharge cell.

30. The plasma display panel of claim 29, wherein the auxiliary metal electrode pair are formed into three pairs which are one pair in the outward side of the center of discharge cell and each one pair around the outward side of the center of discharge cell.

31. The plasma display panel of claim 29, wherein the auxiliary metal electrode pair formed in the outward side of the center of discharge cell are positioned on the more outward side of discharge gap than the auxiliary metal electrode pair formed around the outward side of the center of discharge cell.

32. The plasma display panel of claim 30, wherein the auxiliary metal electrode pair formed in the outward side of the center of discharge cell are positioned on the more outward side of discharge gap than the auxiliary metal electrode pair formed around the outward side of the center of discharge cell.

33. The plasma display panel of claim 28, wherein the auxiliary metal electrode pair are formed in equidistance, respectively.

34. The plasma display panel of claim 25, wherein the auxiliary metal electrode pair are quadrangular shape.

35. The plasma display panel of claim 34, wherein the auxiliary metal electrode pair are rectangular form in the direction of the longitudinal axis of the main metal electrode.

36. The plasma display panel of claim 25, wherein a width of the auxiliary metal electrode pair equals to a width of the main metal electrode pair.

37. The plasma display panel of claim 25, wherein a distance between the main metal electrode and the center of the discharge gap is less than ¼ of a length of the discharge cell.

* * * * *